US008695359B2

(12) United States Patent
Bortoletto et al.

(10) Patent No.: US 8,695,359 B2
(45) Date of Patent: Apr. 15, 2014

(54) WATER CIRCULATION AND DRAINAGE SYSTEM FOR AN ICEMAKER

(75) Inventors: Anderson Bortoletto, Waunakee, WI (US); Rogerio Soares Brisola, Joinville (BR); Fernando Luiz Freitas Filho, Joinville (BR); William Silva, Joinville (BR); Vanessa Christina Riberio, Joinville (BR); Simone M. Vidal, Curitiba (BR); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 351 days.

(21) Appl. No.: 13/166,016

(22) Filed: Jun. 22, 2011

(65) Prior Publication Data

US 2012/0324914 A1 Dec. 27, 2012

(51) Int. Cl.
*F25C 1/00* (2006.01)

(52) U.S. Cl.
USPC ..... 62/66

(58) Field of Classification Search
USPC ..... 62/66; 137/263, 132, 147, 590.5; 108/24
See application file for complete search history.

(56) References Cited

U.S. PATENT DOCUMENTS

| | | | | | |
|---|---|---|---|---|---|
| 1,825,698 | A | | 10/1931 | King | |
| 2,285,946 | A | * | 6/1942 | Kalischer | 62/176.6 |
| 2,303,138 | A | * | 11/1942 | Philipp | 62/287 |
| 2,349,367 | A | | 5/1944 | Muffly | |
| 2,739,729 | A | * | 3/1956 | Jonas | 220/318 |
| 2,765,633 | A | * | 10/1956 | Muffly | 62/278 |
| 3,380,261 | A | | 4/1968 | Hendrix et al. | |
| 3,418,823 | A | | 12/1968 | Salimbeni Vivai | |
| 3,433,030 | A | | 3/1969 | Jacobs | |
| 3,455,119 | A | * | 7/1969 | Bright | 62/180 |
| 3,526,100 | A | | 9/1970 | Briel | |
| 3,995,922 | A | * | 12/1976 | Ohashi | 312/265.5 |
| 4,184,339 | A | | 1/1980 | Wessa | |
| 4,199,956 | A | | 4/1980 | Lunde | |
| 4,207,750 | A | | 6/1980 | Simkens | |
| 4,896,800 | A | | 1/1990 | Corey | |
| 5,032,157 | A | | 7/1991 | Ruff | |
| 5,187,948 | A | | 2/1993 | Frohbieter | |
| 5,207,761 | A | | 5/1993 | Ruff | |
| 5,212,957 | A | * | 5/1993 | Ruff | 62/124 |
| 5,272,884 | A | | 12/1993 | Cur et al. | |
| 5,297,394 | A | | 3/1994 | Frohbieter et al. | |

(Continued)

FOREIGN PATENT DOCUMENTS

| | | |
|---|---|---|
| EP | 0227611 A1 | 7/1987 |
| EP | 0580950 A1 | 2/1994 |

(Continued)

*Primary Examiner* — Ljiljana Ciric
*Assistant Examiner* — Alexis Cox

(57) ABSTRACT

A refrigerator having a water circulation and drainage system includes a fresh food compartment with a liner and a drain, an icemaker system having an ice forming cavity with a draining mechanism, and an ice storage bin coupled to a drain line for draining excess liquid from the ice storage bin. The water circulation and drainage system includes a water tank having an inlet port and an overflow device for draining water. The system also includes a drainage tank having a first water tank inlet port for receiving water from the overflow device of the water tank, a second water inlet port for receiving water from the ice storage bin, and a third inlet port for receiving water from the liner.

18 Claims, 4 Drawing Sheets

(56) References Cited

U.S. PATENT DOCUMENTS

| | | | | |
|---|---|---|---|---|
| 5,375,432 | A | 12/1994 | Cur | |
| 5,425,243 | A | 6/1995 | Sanuki et al. | |
| 5,987,900 | A | 11/1999 | Love | |
| 6,000,228 | A | 12/1999 | Johnson et al. | |
| 6,205,807 | B1 * | 3/2001 | Broadbent | 62/347 |
| 6,647,739 | B1 | 11/2003 | Kim et al. | |
| 6,688,130 | B1 | 2/2004 | Kim | |
| 6,688,131 | B1 | 2/2004 | Kim et al. | |
| 6,742,351 | B2 | 6/2004 | Kim et al. | |
| 6,907,744 | B2 | 6/2005 | Miller et al. | |
| 6,952,937 | B2 | 10/2005 | Choi et al. | |
| 7,062,936 | B2 | 6/2006 | Rand et al. | |
| 7,082,782 | B2 | 8/2006 | Schlosser et al. | |
| 7,197,888 | B2 * | 4/2007 | LeClear et al. | 62/186 |
| 2004/0255606 | A1 * | 12/2004 | Hornung | 62/340 |
| 2006/0225454 | A1 * | 10/2006 | Athanasiou | 62/440 |
| 2009/0260371 | A1 | 10/2009 | Kuehl et al. | |
| 2009/0293508 | A1 | 12/2009 | Rafalovich et al. | |
| 2011/0185760 | A1 * | 8/2011 | Suh et al. | 62/344 |
| 2011/0214447 | A1 * | 9/2011 | Bortoletto et al. | 62/340 |

FOREIGN PATENT DOCUMENTS

| | | | |
|---|---|---|---|
| EP | 0580952 | A1 | 2/1994 |
| EP | 0736738 | A2 | 10/1996 |
| GB | 2189016 | A | 10/1987 |
| WO | 2008095268 | A1 | 8/2008 |
| WO | WO 2008095268 | A1 * | 8/2008 |
| WO | WO 2009078562 | A1 * | 6/2009 |

* cited by examiner

WATER CIRCULATION AND DRAINAGE SYSTEM FOR AN ICEMAKER

BACKGROUND OF THE INVENTION

1. Field of the Invention

The present invention pertains to the art of refrigeration and, more particularly, to icemakers having water circulation and drainage systems for producing clear ice pieces.

2. Description of the Related Art

In general, ice pieces produced with standard icemakers tend to include air bubbles or other imperfections that lend a cloudy or impure appearance to the ice. Therefore, there has been an interest in constructing icemakers which produce clear ice pieces. One approach to preventing the formation of cloudy ice is to agitate or move water in an ice forming cavity during the freezing process. In such a process water may collect at various points within or surrounding the icemaker, such as in the ice collection bin, ice forming chamber, or within a liner of the freezer. Drain lines are often implemented for draining such collected water. For example, U.S. Pat. No. 7,062,936 teaches an ice making method wherein water used for ice formation is collected in a well having an overflow port. Both water drained from the overflow port and water within an ice bin are drained through a common drain pipe. However, water may also collect within the cabinet or liner within which the icemaker is contained. If no outlet port or draining mechanism is provided for draining the liner, undesirable consequences may result. In any case, for these and other reasons, there is considered to exist a need in the art for an ice water circulation and drainage system that provides drainage for all areas of the overall icemaker system.

SUMMARY OF THE INVENTION

The present invention is directed to a refrigerator having a clear icemaker, as well as a water circulation and drainage system for the icemaker. The system including a water tank having an inlet port for receiving water from a water inlet line, a pump and an overflow device for draining water if the water within the water tank rises to an activation point of the overflow device. The system also includes an ice forming cavity including an ice forming device and a draining mechanism. The ice forming cavity is adapted to receive and hold a volume of water pumped from the water tank into the ice forming cavity. The draining mechanism is adapted to transfer water from the ice forming cavity back into the water tank.

An ice storage bin for receiving and storing ice from said ice forming cavity is also provided. The ice forming cavity is coupled to a drain line for draining excess water from the ice storage bin. A liner surrounding at least the water tank, ice forming cavity and ice storage bin also includes an outlet port for draining water from the liner. The system also includes a drainage tank having a first water tank inlet port for receiving water from the overflow device of the water tank, a second water inlet port for receiving water from the ice storage bin, and a third inlet port for receiving water from the liner, wherein the drainage tank includes a single outlet port for draining water from the drainage tank.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
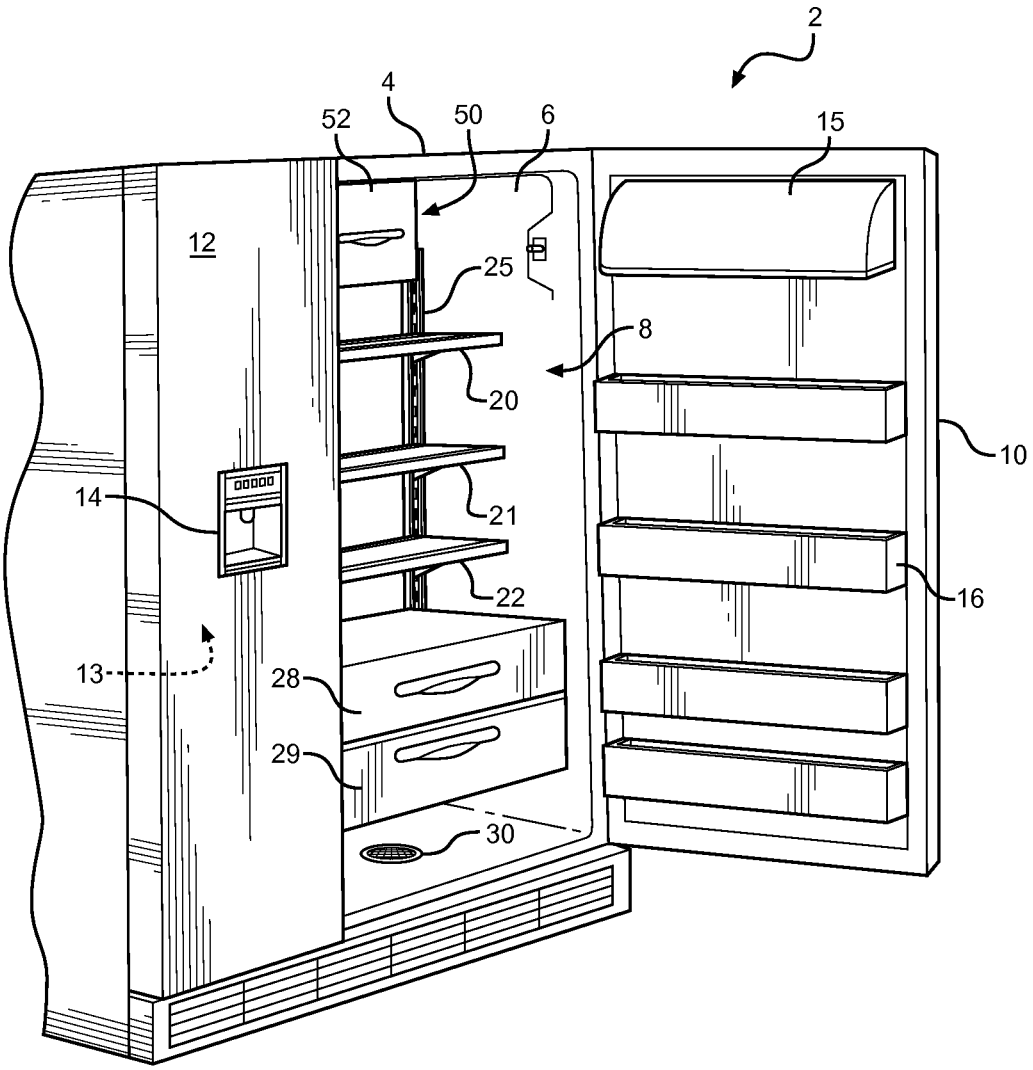
FIG. 1 is a front perspective view of a refrigerator including the water circulation and drainage system for a clear icemaker of the present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. In the embodiment shown, freezer door 12 includes a dispenser 14 that enables a consumer to retrieve ice and/or fresh water without accessing fresh food or freezer compartments 8 and 13. For the sake of completeness, door 10 of refrigerator 2 is shown to include a dairy compartment 15 and various vertically adjustable shelving units, one of which is indicated at 16.

In a manner known in the art, fresh food compartment 8 is provided with a plurality of vertically, height adjustable shelves 20-22 supported by a pair of shelf support rails, one of which is indicated at 25. At a lower portion of fresh food compartment 8 is illustrated bins 28 and 29, with a lowermost bin removed to illustrate additional structure as discussed below. The above described refrigerator structure is known in the art and presented only for the sake of completeness. In accordance with the present invention, a liner drain 30 is positioned at bottom portion of liner 6 for draining liquids from fresh food compartment 8. Liner drain 30 is actually fluidly connected to a clear icemaker system 50 of the invention, with clear icemaker system 50 including an ice storage bin 52 and a water circulation and drainage system which is generally indicated at 100 in FIGS. 2-6.

Figure 2:
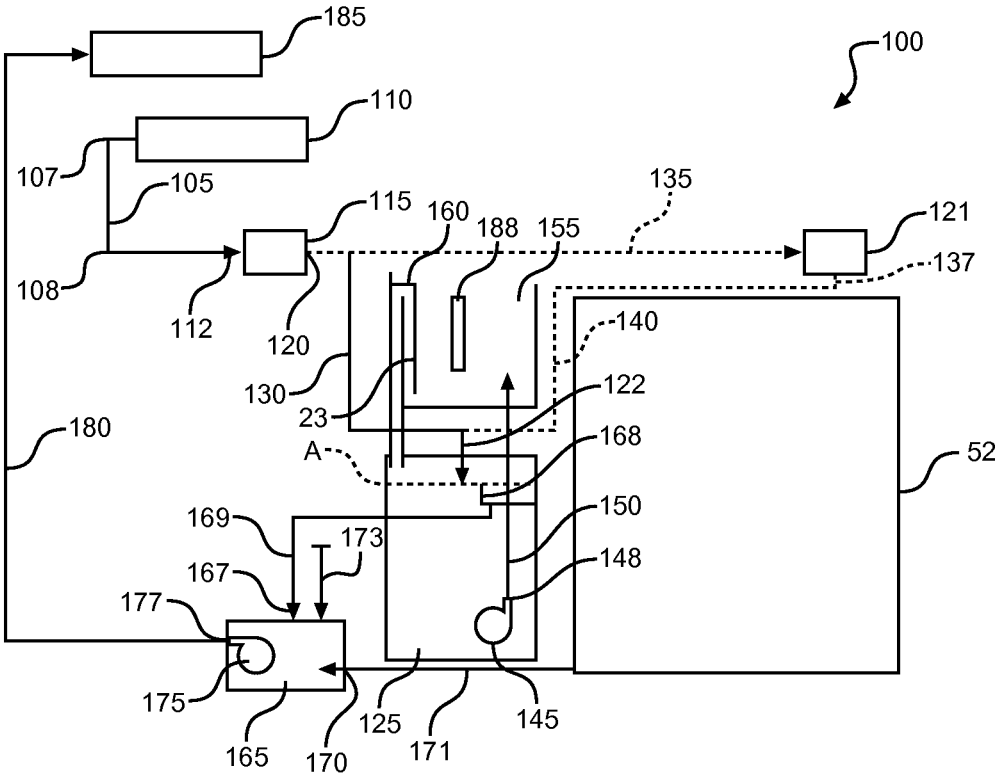
FIG. 2 is a schematic view of the icemaker water circulation and drainage system of the invention, illustrating the system prior to ice formation.

As illustrated in FIG. 2, water circulation and drainage system 100 includes a water inlet line 105 having a first end 107 and a second end 108 for supplying clean water to icemaker system 50. First end 107 of inlet line 105 is coupled to a tap 110 and second end 108 is connected to an inlet port 112 of a water valve 115. Water valve 115 also includes an outlet port 120, which may be connected to a filter 121 or directly to an inlet port 122 of a water tank 125 by way of water line 130. In an embodiment where filter 121 is employed, water is directed through water line 135 to filter 121, then through outlet port 137 of filter 121 and through water line 140 prior to reaching inlet port 122 of water tank 125. Additional details of the water circulation system can be found in co-assigned WO 2008/095268, which is hereby incorporated by reference.

A water pump 145 operates to draw water from water tank 125 and includes an outlet port 148 for pumping water through water pipe 150 to ice forming cavity 155 of icemaker system 50. An ice forming cavity draining mechanism, preferably a siphon unit 160, is provided within ice forming cavity 155 for draining water from ice forming cavity 155. At this point, it should be noted that icemaker system 50 can take various forms known in the art for providing clear ice. In addition, draining mechanism may be another device capable of transferring water from ice forming cavity 155 to water tank 125. Icemaker system 50 also includes an ice forming device for forming ice cubes. In one preferred embodiment, the ice forming device is a finger-type evaporator having a refrigerant duct with an elongated length and a plurality of fingers are employed as discussed further below. Basically, the fingers are small tubes connected to the duct, whereby coolant flowing inside the duct establishes cold temperatures at the fingers. The evaporator can be part of an overall cooling system for refrigerator 2 or a separate, dedicated evaporator for icemaker system 50. In any case, with low-temperature coolant running through the evaporator, water within ice forming cavity 155 contacts the fingers and is formed into ice. More specifically, the ice is formed in such a manner that the water freezes around the fingers, layer-by-layer, through heat exchange between the coolant and water. Again, this is only a preferred icemaking arrangement and other clear icemakers could be employed with the invention.

Water circulation and drainage system 100 also includes a drainage tank 165 for receiving waste water. Drainage tank 165 includes an inlet port 167 for receiving water from an overflow device 168 in water tank 125 through a drain line 169. Drainage tank 165 also includes an inlet port 170 for receiving melted ice through drain line 171 from ice storage bin 52. An additional inlet port 173 is provided for receiving excess water from condensation, spillage or leakage associated with liner 6 of fresh food compartment 8. Drain 30 collects fluid from liner 6, which flows to drainage tank 165 via inlet port 173, preferably by gravity. A drain pump 175 is provided to pump waste water from drainage tank 165. More specifically, drainage tank 165 includes an outlet port 177 linked to drain pump 175 for draining water through a discharge line 180 to a discharge pipe 185.

With reference to FIGS. 2-6, the operation of the circulation and draining system 100 will be described. FIG. 2 illustrates the state of icemaker system 50 prior to beginning an ice making cycle, but after filling water tank 125. As described above, water flows from tap 110 to water tank 125 either directly through water line 130 or, if water filtration is desired, by passing through filter 121 and traveling though water line 140 to water tank 125. The water level within water tank 125 is filled to line A, which is well above pump 145 and preferably just below an activation point of overflow device 168.

Figure 3:
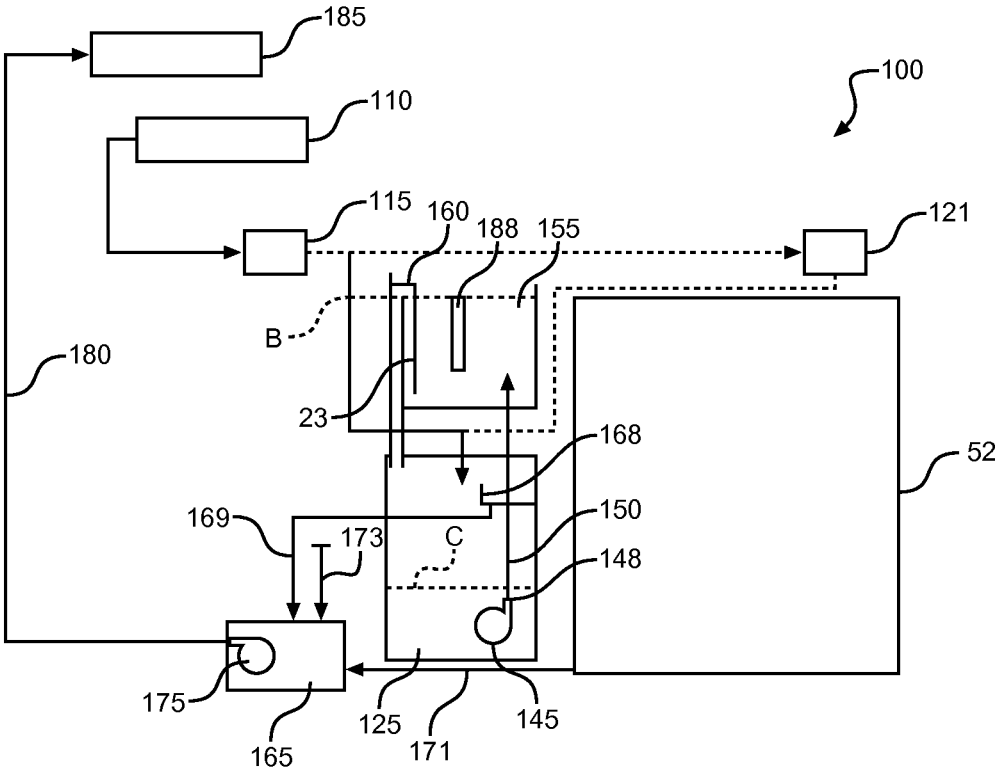
FIG. 3 is a schematic view of the icemaker water circulation and drainage system of the invention, illustrating the system when water is being transferred from a water storage tank to an ice forming cavity.

When an ice making cycle is initiated, water pump 145 pumps water through water pipe 150 into ice forming cavity 155, as depicted in FIG. 3. It is particularly necessary that the water level reach the first ice forming cavity water level, as indicated by line B, within ice forming cavity 155 so that fingers 188 of the evaporator (discussed above) are immersed in water and to ensure a necessary volume of water is present in ice forming cavity 155 to initiate the ice production process. The water level is also designed to stay below a top end of siphon system 160 to prevent premature drainage of the water within ice forming cavity 155. As the water level within ice forming cavity 155 reaches a first ice forming cavity water level, line B, the water level within water tank 125 is lowered to about line C, which is still above an inlet port (not shown) of pump 145. Once the appropriate water levels have been reached and the ice production process is initiated, pump 145 stops water transfer from water tank 125 to ice forming cavity 155. Preferably, pump 145 remains inoperative during the entire ice formation stage inside ice forming cavity 155. In addition, it is preferred that a mechanism for agitating water in ice forming cavity 155 is provided as known in the art to assist in the formation of clear ice pieces.

Figure 4:
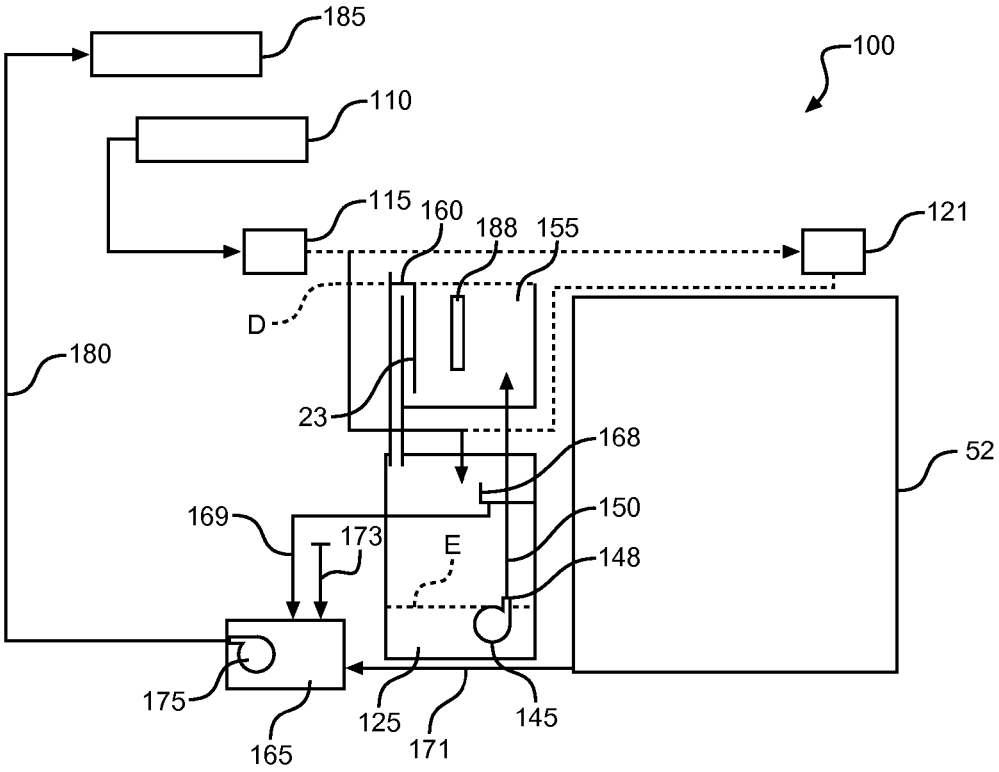
FIG. 4 is a schematic view of the icemaker water circulation and drainage system of the invention, illustrating the system just prior to draining the ice forming cavity following ice formation.
Figure 5:
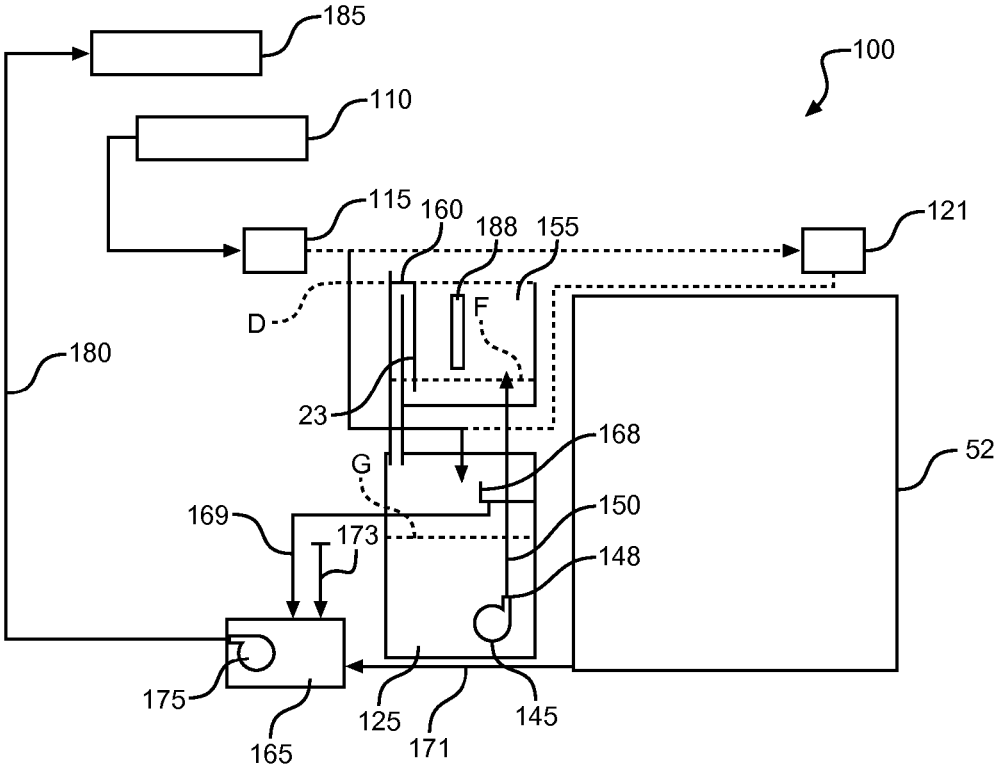
FIG. 5 is a schematic view of the icemaker water circulation and drainage system of the invention, illustrating the system following intermediate stage drainage of the ice forming cavity.
Figure 6:
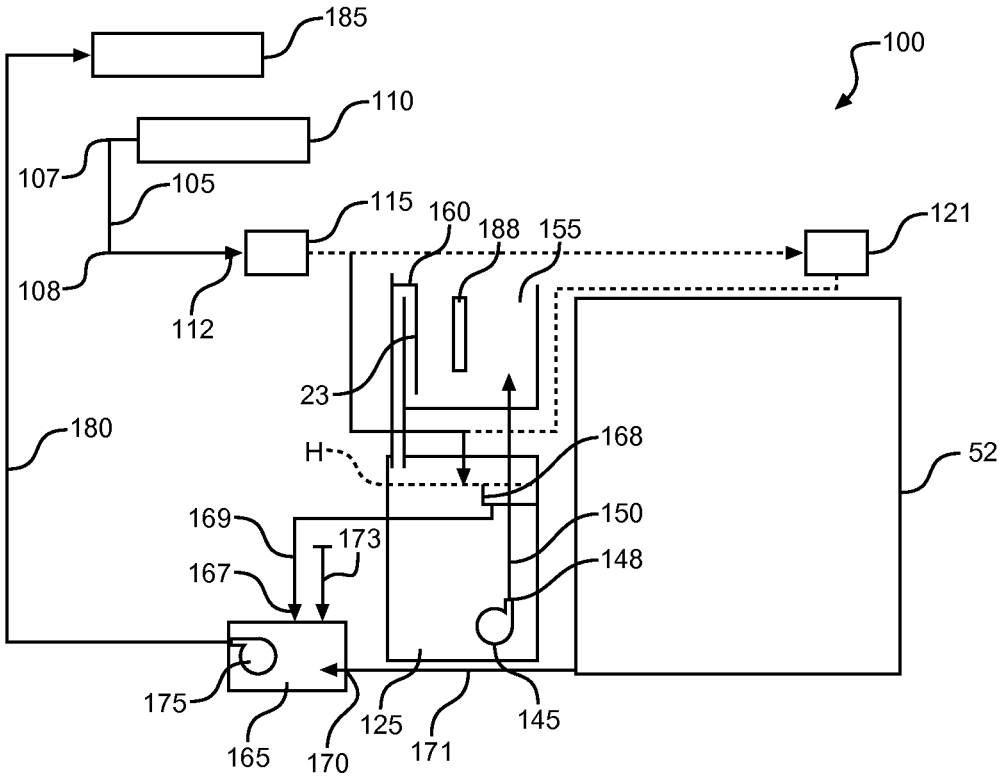
FIG. 6 is a schematic view of the icemaker water circulation and drainage system of the invention, illustrating the system following complete drainage of the ice forming cavity.

When ice forming cavity 155 is filled with water, ice pieces then form around evaporator fingers 188. Following the formation stage for the ice pieces in ice forming cavity 155, pump 145 pumps an additional amount of water through water pipe 150 such that the level of water in ice forming cavity reaches a second ice forming cavity water level, indicated by line D, as shown in FIG. 4, and the water level within water tank 125 falls below outlet port 148 of pump 145, as indicated by line E. At the second ice forming cavity water level, line D, the water in ice forming cavity 155 is just above a top end of siphon system 160. Thus, a difference in pressure between ice forming cavity 155 and water tank 125 causes water to freely flow out of ice forming cavity 155 through siphon system 160 into water tank 125, as illustrated by FIG. 5. Exemplary water levels F within ice forming cavity 155 and level G within water tank 125 have been chosen for illustrative purposes of an intermediate stage. Siphoning continues until essentially all of the water has been drained through siphon system 160 into water tank 125, as represented in FIG. 6.

As the manner in which the ice is harvested is not part of the present invention, it will not be described herein in detail. In general, various harvesting arrangements known in the art can be utilized, mainly depending on the particular type of icemaker employed. In any case, following the harvesting of a batch of ice, water tank 125 is refilled in order to re-establish an original water level for ice making system 50. In addition, clean water from tap 110 fills tank 125 after each cycle to ensure that the salt concentration of the water is maintained at an acceptable level to form clear ice. Again, water tank 125 includes overflow device 168 for preventing the over-filling of tank 125. That is, if water inside tank 125 rises above an activation point of overflow device 168, as illustrated by level H, water automatically flows from overflow device 168 through water connection 169 to an inlet port 167 of drainage tank 165. As also discussed above, drainage tank 165 also includes an inlet port 170 for receiving melted ice from ice storage bin 52. When ice when ice sits in ice storage bin 52, it melts. That is, ice in ice storage bin 52 melts depending on the operational conditions of refrigerator 2, preferably taking into account times of power outages, and the location of ice storage bin 52 which is preferably located in the fresh food compartment 8 rather than freezer compartment 13. Any melted ice creates a flow of water from ice storage bin 52 through drain line 171 to drainage tank 165. Again, drainage tank 165 also includes inlet 173 for receiving excess water condensation, spillage or leakage. In any case, if drainage tank 165 is filled beyond a sensed level, drain pump 175 is activated to pump waste water from drainage tank 165 to discharge pipe 185.

Based on the above it should be readily apparent that the present invention provides a water circulation and drainage system 100 for use with an icemaker 50 for producing clear ice pieces. Among other important features, water circulation and drainage system 100 includes a common drainage tank 165 for multiple inlets from distinct refrigerator components, such as first, second and third inlets in order to receive fluid from water tank 125, ice storage bin 52 and liner 8.

In any case, although described with reference to preferred embodiments of the invention, it should be readily understood that various changes and/or modifications can be made to the invention without departing from the spirit thereof. In general, the invention is only intended to be limited by the scope of the following claims.

What is claimed is:

1. A refrigerator comprising:

a cabinet including a fresh food compartment and a freezer compartment adapted to be cooled by a refrigerant circulation system, said fresh food compartment having a liner with a drain for draining liquid from the liner;

an icemaker system located in the fresh food compartment, said icemaker system including an ice forming cavity and a draining mechanism, said ice forming cavity being adapted to receive and hold a volume of water and said draining mechanism being adapted to transfer water out of the ice forming cavity;

an ice storage bin for receiving and storing ice from said ice forming cavity, said ice storage bin being coupled to a drain line for draining excess water from said ice storage bin; and a water circulation and drainage system including:

a water inlet line;

a water tank configured to receive water from the water inlet line, said water tank also including an overflow device for draining water from the water tank if a water level within the water tank rises to an activation point of the overflow device, said water tank being in fluid communication with the ice forming cavity to receive water from the draining mechanism of the ice forming cavity;

a pump configured to transfer water from the water tank to the ice forming cavity; and a drainage tank including a first water inlet operably connected to receive water from said overflow device of the water tank, a second water inlet operably connected to receive water from said ice storage bin, and a third inlet operably connected to the drain of the liner, said drainage tank also including an outlet port operably connected to drain water from the drainage tank.

2. The refrigerator according to claim 1, wherein the ice storage bin is located in the fresh food compartment.

3. The refrigerator according to claim 1, wherein the drain is positioned at a bottom portion of the liner and configured to gravity feed water to the drainage tank through the third water inlet.

4. The refrigerator according to claim 1, wherein the outlet port of the drainage tank constitutes a common outlet port for draining water received by the drainage tank from each of the first, second and third inlets.

5. The refrigerator according to claim 4, further comprising: a drain pump operably connected to to the outlet port of the drainage tank for draining water from the drainage tank.

6. The refrigerator according to claim 1, wherein the water tank is positioned below the ice forming cavity.

7. The refrigerator according to claim 6, wherein the ice forming cavity draining mechanism constitutes a siphon.

8. In a refrigerator including a fresh food compartment defined by a liner having a drain, an icemaker and an ice storage bin, a water circulation and drainage system for the refrigerator comprising:

a water inlet line;

a water tank configured to receive water from the water inlet line, said water tank also including an overflow device for draining water from the water tank if a water level within the water tank rises to an activation point of the overflow device, said water tank configured to be in fluid communication with the icemaker to receive drainage water from the icemaker;

a pump configured to transfer water from the water tank to the icemaker; and a drainage tank including a first water inlet operably connected to receive water from said overflow device of the water tank, a second water inlet operably connected to receive water from the ice storage bin, and a third inlet operably connected to the drain of the liner, said drainage tank also including an outlet port operably connected to drain water from the drainage tank.

9. The water circulation and drainage system according to claim 8, wherein the ice storage bin is located in the fresh food compartment.

10. The water circulation and drainage system according to claim 8, wherein the drain is positioned at a bottom portion of the liner and configured to gravity feed water to the drainage tank through the third water inlet.

11. The water circulation and drainage system according to claim 8, wherein the outlet port of the drainage tank constitutes a common outlet port for draining water received by the drainage tank from each of the first, second and third inlets.

12. The water circulation and drainage system according to claim 11, further comprising: a drain pump operably connected to the outlet port of the drainage tank for draining water from the drainage tank.

13. The water circulation and drainage system according to claim 8, wherein the water tank is positioned below the ice forming cavity.

14. The water circulation and drainage system according to claim 13, wherein the ice forming cavity draining mechanism constitutes a siphon.

15. A method of circulating and draining water within a refrigerator including a fresh food compartment having a liner with a drain, an icemaker system including an ice forming cavity with a draining mechanism, and an ice storage bin, said method comprising:

supplying water from a water inlet line to a water tank;

following the supplying water, pumping water from said water tank to the ice forming cavity until said ice forming cavity is filled to a first water level for ice making;

following pumping water, forming ice with an ice making device within said ice forming cavity;

after forming ice, pumping additional water to the ice forming cavity until said ice forming cavity is filled to a second water level for initiating draining of the water from the ice forming cavity;

following pumping additional water, draining the ice forming cavity and collecting the water drained from the ice forming cavity in the water tank;

following collecting the water drained, adding additional water to the water tank;

draining water from the water tank into a drainage tank when the water level in the water tank rises above an overflow device in the water tank, the water from the water tank passing through a first inlet;

draining water from the ice storage bin into the drainage tank through a second inlet;

draining water from the drain of said liner to the drainage tank through a third inlet; and disposing of water collected within said drainage tank through a drain outlet.

16. The method of claim 15, wherein water is removed from the drainage tank by pumping the water out through the drain outlet which constitutes a common outlet for each of the water tank, ice storage bin and drain of the liner.

17. The method of claim 15, wherein draining of the water from the ice forming cavity constitutes siphoning the water to the water tank.

18. The method of claim 15, wherein the drainage tank receives water from the drain of said liner through gravity.

* * * * *